US009010236B2

(12) United States Patent
Ishibashi et al.

(10) Patent No.: US 9,010,236 B2
(45) Date of Patent: Apr. 21, 2015

(54) LINEAR ACTUATOR

(75) Inventors: Koichiro Ishibashi, Tsukubamirai (JP); Motohiro Sato, Toride (JP); Toshio Sato, Tsukuba (JP)

(73) Assignee: SMC Kabushiki Kaisha, Tokyo (JP)

( * ) Notice: Subject to any disclaimer, the term of this patent is extended or adjusted under 35 U.S.C. 154(b) by 514 days.

(21) Appl. No.: 13/442,242

(22) Filed: Apr. 9, 2012

(65) Prior Publication Data

US 2012/0260797 A1 Oct. 18, 2012

(30) Foreign Application Priority Data

Apr. 13, 2011 (JP) ..... 2011-088862

(51) Int. Cl.
*F15B 15/26* (2006.01)

(52) U.S. Cl.
CPC ..... *F15B 15/261* (2013.01)

(58) Field of Classification Search
USPC ..... 92/15, 22, 23, 26, 28, 88
See application file for complete search history.

(56) References Cited

U.S. PATENT DOCUMENTS 3,554,094 A * 1/1971 Gross ..... 92/28
7,044,047 B1 * 5/2006 Bennett et al. ..... 92/13.4

FOREIGN PATENT DOCUMENTS

JP 54-9292 (U) 1/1979
JP 7-110011 4/1995
JP 8-28510 2/1996
JP 08028510 A * 2/1996
JP 9-189304 7/1997
JP 09189304 A * 7/1997
JP 2003-527545 9/2003

OTHER PUBLICATIONS

Office Action issued Jun. 18, 2013 in Japanese Patent Application No. 2011-088862 (with English translation of pertinent portion).

* cited by examiner

*Primary Examiner* — Thomas E Lazo
(74) *Attorney, Agent, or Firm* — Oblon, McClelland, Maier & Neustadt, L.L.P.

(57) ABSTRACT

A linear actuator includes a cylinder main body, which is provided at one end thereof with a lock mechanism capable of restricting displacement of a slide table. The lock mechanism is equipped with a lock plate and a sub-piston. The lock plate is rotatable toward a side of the slide table by an elastic force of a spring, inserted into an insertion groove, and restricts displacement of the slide table. The sub-piston is displaced by a pressure fluid supplied to a supply port, and releases a displacement restricted state of the slide table by the lock plate.

19 Claims, 7 Drawing Sheets

LINEAR ACTUATOR

CROSS-REFERENCE TO RELATED APPLICATION

This application is based upon and claims the benefit of priority from Japanese Patent Application No. 2011-088862 filed on Apr. 13, 2011, of which the contents are incorporated herein by reference.

BACKGROUND OF THE INVENTION

1. Field of the Invention

The present invention relates to a linear actuator for reciprocally displacing a slide table along an axial direction of a cylinder main body by introducing a pressure fluid from fluid inlet/outlet ports.

2. Description of the Related Art

Heretofore, as a means for transporting workpieces or the like, for example, a linear actuator made up from a fluid pressure cylinder or the like has been used. As disclosed in Japanese Laid-Open Patent Publication No. 07-110011, the present applicants have proposed a linear actuator, which is capable of transporting workpieces loaded onto a slide table, by causing linear reciprocal movement of the slide table along a cylinder main body.

SUMMARY OF THE INVENTION

A general object of the present invention is to provide a linear actuator, which is capable of reliably restricting displacement of a slide table in an axial direction, and in which enlargement in scale of the linear actuator can be suppressed.

The present invention is characterized by a linear actuator for reciprocally displacing a slide table along an axial direction of a cylinder main body by introducing a pressure fluid from fluid inlet/outlet ports, comprising the cylinder main body, which communicates with the fluid inlet/outlet ports, and having a cylinder chamber into which the pressure fluid is introduced, the slide table, which is reciprocally displaced along the axial direction of the cylinder main body, a cylinder mechanism having a piston slidably disposed for displacement along the cylinder chamber, and which reciprocally displaces the slide table by displacement of the piston, a lock mechanism having a locking member that is displaceable perpendicular to a displacement direction of the slide table and comes into engagement with the slide table, and a biasing means that causes displacement of the locking member, wherein the lock mechanism is disposed at one end of the cylinder main body and restricts reciprocal displacement of the slide table.

According to the present invention, the lock mechanism, which is capable of restricting reciprocal displacement of the slide table, is provided at one end of the cylinder main body. The locking member of the lock mechanism is displaced perpendicular to the displacement direction of the slide table, and can restrict reciprocal displacement of the slide table by coming into engagement with the slide table. Owing thereto, enlargement in scale in the direction of displacement of the linear actuator can be prevented. As a result, enlargement in scale in the longitudinal direction of the linear actuator can be suppressed, and reciprocal displacement of the slide table can reliably be restricted through the lock mechanism.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
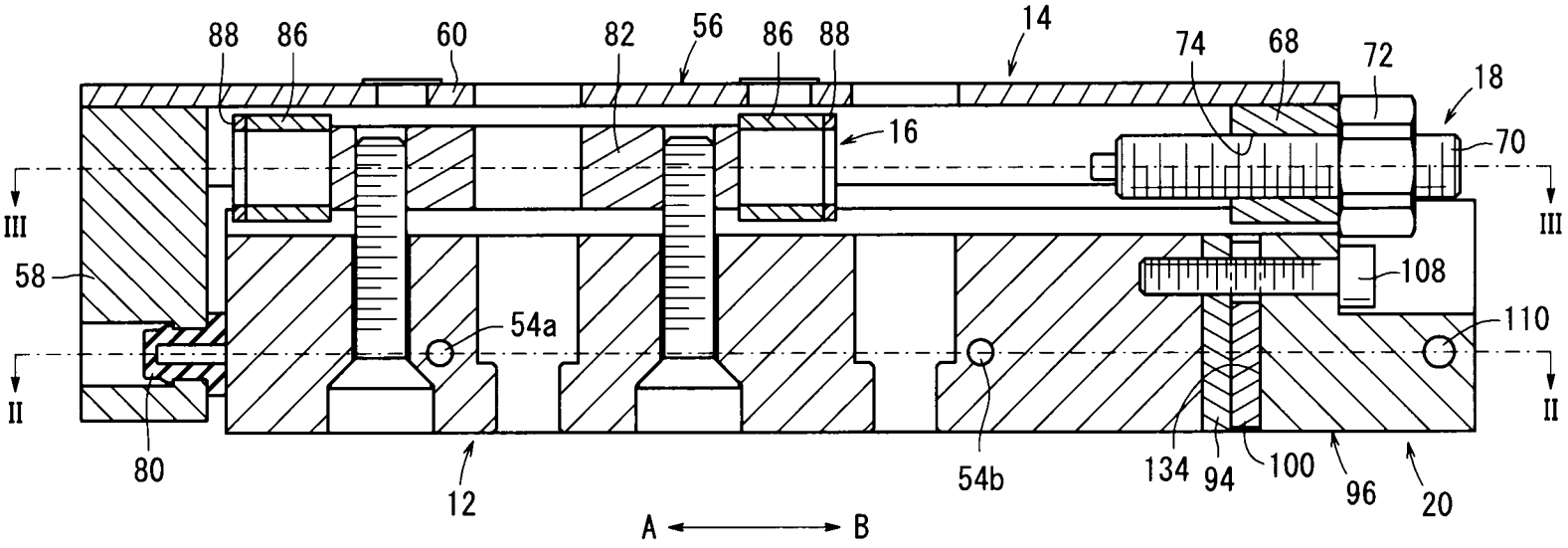
FIG. 1 is an overall cross sectional view of a linear actuator according to an embodiment of the present invention.

In FIG. 1, reference numeral 10 indicates a linear actuator according to an embodiment of the present invention.

As shown in FIGS. 1 to 5, the linear actuator 10 includes a cylinder main body 12, a slide table 14 disposed on an upper part of the cylinder main body 12, and which is displaced reciprocally in a linear fashion along a longitudinal direction (the direction of arrows A and B) of the cylinder main body 12, a guide mechanism 16 disposed between the cylinder main body 12 and the slide table 14, which guides the slide table 14 along the longitudinal direction (the direction of arrows A and B), a stroke adjustment mechanism 18 that is capable of adjusting the displacement amount along an axial direction of the slide table 14, and a lock mechanism 20 that restricts displacement of the slide table 14.

The cylinder main body 12 is formed with a rectangular shape in cross section with a predetermined length along the longitudinal direction. First and second ports (fluid inlet/outlet ports) 22, 24 for supply and discharge of a pressure fluid are formed perpendicularly to the longitudinal direction on one side surface of the cylinder main body 12. Further, third and fourth ports (fluid inlet/outlet ports) 26, 28 for supply and discharge of the pressure fluid are formed on another side surface of the cylinder main body 12 (See FIG. 2). The first through fourth ports 22, 24, 26, 28 communicate respectively with a pair of first and second through holes (cylinder chambers) 34 and 36, which shall be described later.

The first and second ports 22, 24 and the third and fourth ports 26, 28 are used by connection of pipes (not shown) selectively with respect to either one of pairs thereof that is appropriate for use in the environment in which the linear actuator 10 is installed. For example, in the case that supply and discharge of a pressure fluid are performed using the first and second ports 22, 24, then blocking plugs 30 are mounted respectively with respect to the third and fourth ports 26, 28.

Furthermore, sensor attachment grooves 32, which extend along the longitudinal direction (the direction of arrows A and B), are formed respectively in the one side surface and the other side surface of the cylinder main body 12 (see FIG. 4), with non-illustrated detection sensors being installed in the sensor attachment grooves 32.

Figure 2:
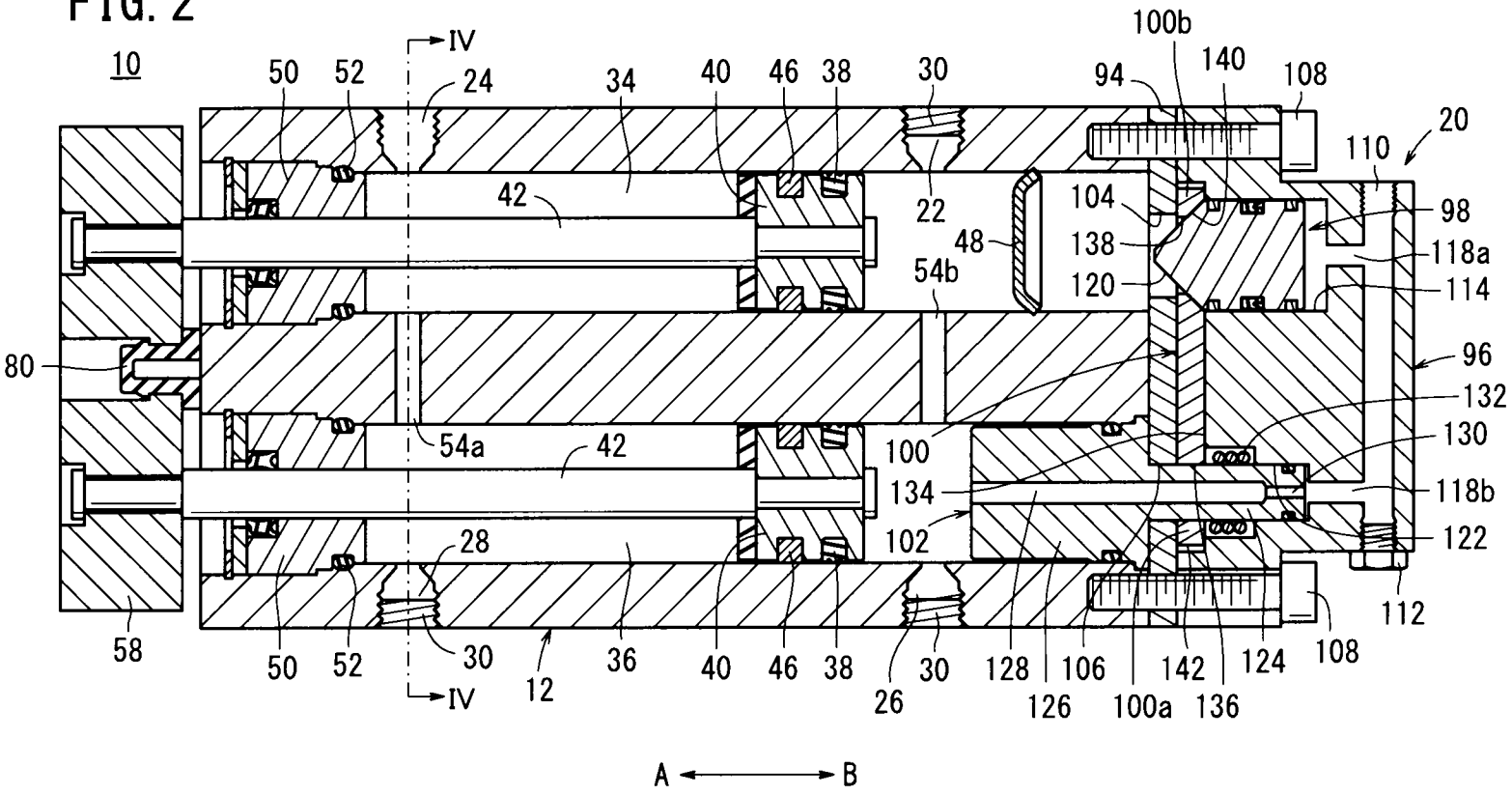
FIG. 2 is a cross sectional view taken along line II-II of FIG. 1.

Further, as shown in FIG. 2, in the interior of the cylinder main body 12, the pair of first and second through holes 34, 36 are formed that penetrate along the longitudinal direction (the direction of arrows A and B). The first through hole 34 and the second through hole 36 are arranged substantially in parallel to each other and are separated by a predetermined distance. A cylinder mechanism 44, including pistons 40 having sealing rings 38 mounted on outer circumferential surfaces thereof, and piston rods 42 connected to the pistons 40, is accommodated in the first and second through holes 34, 36. The first and second through holes 34, 36 penetrate in straight lines from one end portion to the other end portion of the cylinder main body 12.

The cylinder mechanism 44 is constituted by mounting the pair of pistons 40 and the piston rods 42 respectively in the first and second through holes 34, 36. Further, magnets 46 are mounted on the outer circumferential surfaces of the pistons 40 adjacent to the sealing rings 38. As a result of magnetism from the magnets 46 being detected by the detection sensors (not shown) that are installed in the sensor attachment grooves 32, the displacement position of the pistons 40 along the axial direction (the direction of arrows A and B) is detected.

Further, one end of the first through hole 34 is blocked by a cap 48, and one end of the second through hole 36 is blocked by a coupling 102 of the later-described lock mechanism 20.

On the other hand, other ends of the first and second through holes 34, 36 are blocked and sealed hermetically by rod holders 50, which are retained by retaining rings. On outer circumferential surfaces of the rod holders 50, o-rings 52 are installed via annular grooves, in order to prevent passage and leakage of pressure fluid from between the rod holders 50 and the first and second through holes 34, 36.

The first through hole 34 communicates respectively with the first and second ports 22, 24, the second through hole 36 communicates respectively with the third and fourth ports 26, 28, and in addition, the first through hole 34 and the second through hole 36 communicate mutually with each other via a pair of connection passages 54*a*, 54*b* formed therebetween.

Figure 4:
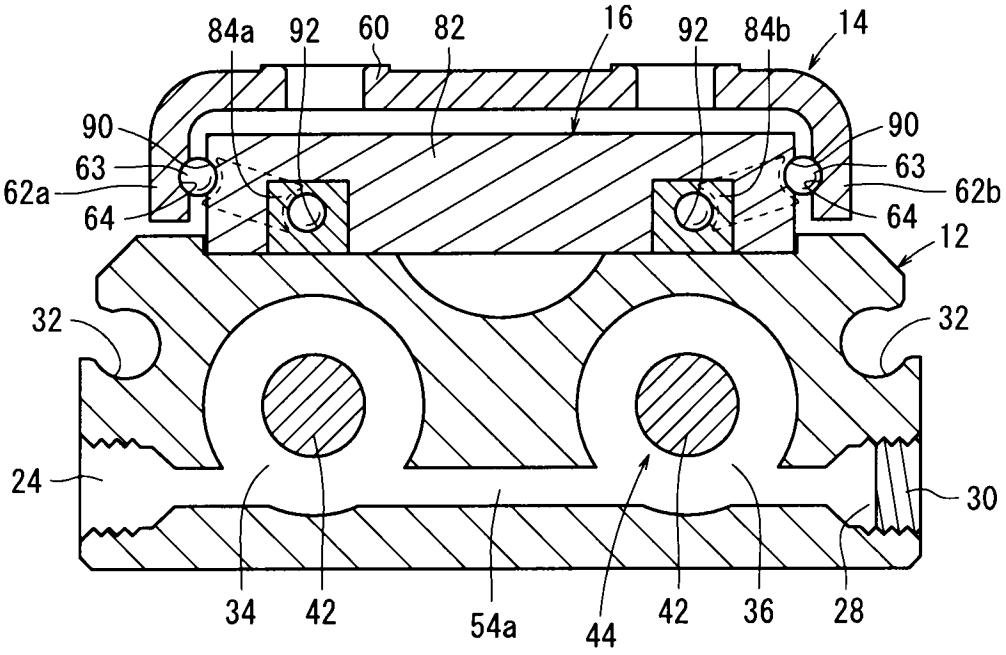
FIG. 4 is a cross sectional view taken along line IV-IV of FIG. 2.
Figure 5:
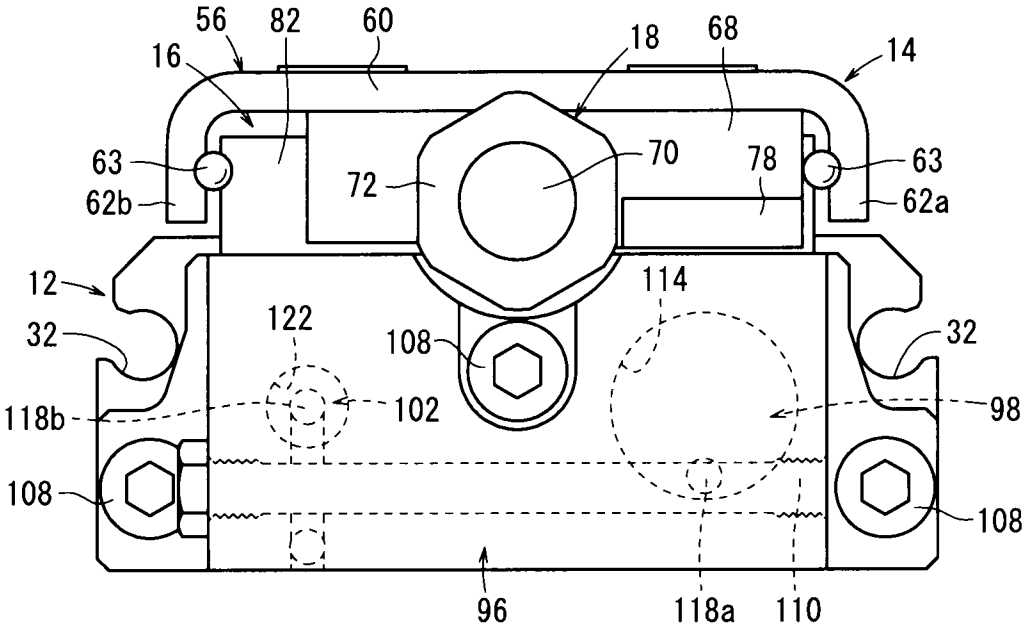
FIG. 5 is a front view of the linear actuator shown in FIG. 1 as seen from a side of a lock mechanism.

As shown in FIGS. 1 and 4, the slide table 14 is equipped with a table main body 56, the stroke adjustment mechanism 18, which is connected to one end of the table main body 56, and an end plate 58, which is connected to the other end of the table main body 56. In addition, the end plate 58 is connected perpendicularly with respect to the table main body 56.

The table main body 56 is made up from a base portion 60 that extends with a predetermined thickness along the longitudinal direction (the direction of arrows A and B), and a pair of guide walls 62*a*, 62*b*, which extend downward perpendicularly from opposite sides of the base portion 60. First ball guide grooves 64, in which balls 63 of a later-described guide mechanism 16 are guided, are formed on inner surfaces of the guide walls 62*a*, 62*b*.

Further, a holder 68 of the later-described stroke adjustment mechanism 18 is fixed through a pair of bolts 66*a* to one end of the table main body 56, whereas the end plate 58 is fixed through another pair of bolts 66*b* to the other end of the table main body 56 (see FIG. 3).

The stroke adjustment mechanism 18 includes the holder 68, which is provided on a lower surface of one end on the table main body 56, a stopper bolt 70 that is screw-engaged with respect to the holder 68, and a lock nut 72 for regulating advancing/retracting movement of the stopper bolt 70. The stroke adjustment mechanism 18 is disposed so as to face toward an end surface of the guide mechanism 16 provided on the cylinder main body 12.

The holder 68 is formed in a block-like shape and has a screw hole 74, with which the stopper bolt 70 is screw-engaged, formed substantially in the center thereof. Further, an insertion groove (groove) 76, which is recessed upwardly by a predetermined depth, and into which a lock plate (locking member) 100 of the later-described lock mechanism 20 is inserted, and an inclined surface 78, which is inclined at a predetermined angle, are formed on a lower surface of the holder 68 (see FIGS. 5 through 7). On the lower surface of the holder 68, the insertion groove 76 is formed with a rectangular shape in cross section on the other end of the holder 68 on the side of the end plate 58 (in the direction of the arrow A), whereas the inclined surface 78 is formed so as to be inclined upwardly toward the one end of the holder 68 on the side of the later-described lock nut 72 (in the direction of the arrow B).

The stopper bolt 70, for example, is made up from a shank-shaped stud bolt with screw threads engraved on the outer circumferential surface thereof, and is formed with a length such that the stopper bolt 70 projects from the screw hole 74 of the holder 68 in a state of threaded engagement with the screw hole 74. Additionally, the lock nut 72 is threaded onto the stopper bolt 70 at a region thereof that projects from an end surface of the holder 68.

In addition, by screw-engagement of the stopper bolt 70 with respect to the holder 68, the stopper bolt 70 is displaced along the axial direction (the direction of arrows A and B) so as to approach toward and separate away from the guide mechanism 16. For example, after the stopper bolt 70 has been screw-rotated so as to project toward the side of the guide mechanism 16 (in the direction of the arrow A) by a predetermined length, by screw-rotating and displacing the lock nut 72 so that the lock nut 72 comes into abutment against the side surface of the holder 68, advancing and retracting movement of the stopper bolt 70 is restricted.

As shown in FIGS. 1 and 2, the end plate 58 is fixed to the other end of the table main body 56 while being disposed so as to face toward the end surface of the cylinder main body 12, and together therewith, ends of the piston rods 42, which are inserted through a pair of rod holes, are fixed respectively to the end plate 58. Owing thereto, the slide table 14 including the end plate 58 is made displaceable together with the piston rods 42 along the longitudinal direction (the direction of arrows A and B) of the cylinder main body 12.

Further, in the end plate 58, a damper 80 made from an elastic material is installed through a damper installation hole at a position between one rod hole and the other rod hole. Because the damper 80 projects from the other side surface of the end plate 58 on the side of the cylinder main body 12, when the end plate 58 is displaced together with the slide table 14, an end portion of the damper 80 abuts against the end surface of the cylinder main body 12, whereby generation of shocks and shock noises, which would be of concern if the end plate 58 and the cylinder main body 12 were to come into direct abutment against each other, can be avoided.

Figure 3:
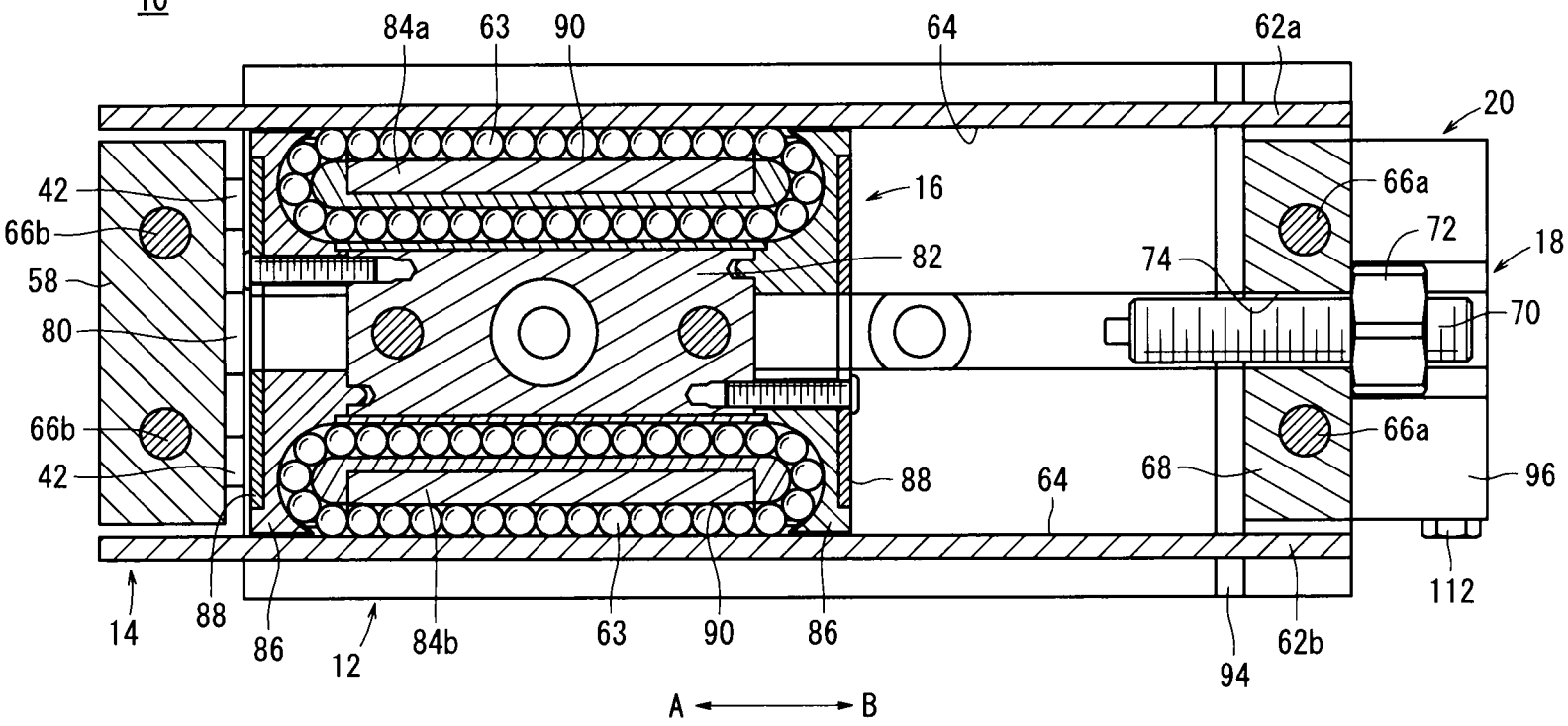
FIG. 3 is a cross sectional view taken along line III-III of FIG. 1.

As shown in FIGS. 1, 3 and 4, the guide mechanism 16 includes a wide and flat guide block 82, a pair of ball circulation members 84*a*, 84*b* disposed on the guide block 82 through which balls 63 circulate, a pair of covers 86 mounted respectively on opposite ends along the longitudinal direction of the guide block 82, and a pair of cover plates 88 that cover respective surfaces of the covers 86.

Second ball guide grooves 90 are formed along the longitudinal direction on both side surfaces of the guide block 82, and at locations proximate to the second ball guide grooves 90, a pair of installation grooves, in which the ball circulation members 84*a*, 84*b* are inserted, penetrate along the longitudinal direction. The second ball guide grooves 90 are formed with semicircular shapes in cross section, such that when the slide table 14 is arranged on an upper part of the guide mechanism 16, the second ball guide grooves 90 are positioned in confronting relation to the first ball guide grooves 64.

The ball circulation members 84*a*, 84*b* are formed with rectangular shapes in cross section corresponding to the installation grooves, and in the interior thereof, ball circulation holes 92 penetrate through which the balls 63 are circulated. On both ends of the ball circulation members 84*a*, 84*b*, reversing members (not shown) for reversing the direction in which the balls 63 circulate are provided respectively.

More specifically, from the ball circulation holes 92 in the ball circulation members 84*a*, 84*b*, the balls 63 are reversed by 180° and roll into the first and second ball guide grooves 64, 90 disposed on the outer sides of the ball circulation members 84*a*, 84*b* through the reversing members.

In addition, when the slide table 14 is reciprocally displaced, the stopper bolt 70 that makes up the stroke adjustment mechanism 18 comes into abutment against the end surface of the guide block 82.

As shown in FIGS. 1 through 7, the lock mechanism 20 is connected to one end of the cylinder main body 12, and includes an end block 96, which is connected through a spacer 94 with respect to the cylinder main body 12, a sub-piston (displaceable body) 98 that undergoes advancing and retracting movements in the interior of the end block 96, a lock plate 100 that is disposed rotatably in the interior of the end block 96, a spring (biasing means) 132 for urging the lock plate 100, and the coupling 102 that establishes communication between the interior of the end block 96 and the second through hole 36 of the cylinder main body 12.

The spacer 94 is formed with a plate like-shape having a predetermined thickness, which is sandwiched between the cylinder main body 12 and the end block 96. Together therewith, the spacer 94 is formed with a first hole 104 that confronts the first through hole 34 of the cylinder main body 12, and a second hole 106 that confronts the second through hole 36 of the cylinder main body 12. The first hole 104 is formed non-coaxially with respect to the first through hole 34, whereas the second hole 106 is formed coaxially with respect to the second through hole 36 (see FIG. 2).

The end block 96 is fixed to one end of the cylinder main body 12 together with the spacer 94 through a plurality of bolts 108. Both side surfaces of the end block 96 are formed with a supply port (fluid inlet/outlet port) 110 therein through which the pressure fluid is supplied. The supply port 110 extends substantially perpendicularly to the longitudinal direction (the direction of arrows A and B) of the cylinder main body 12, and penetrates therethrough so as to open on opposite side surfaces of the end block 96.

In addition, either one of the opposite ends of the supply port 110 that open on both side surfaces of the end block 96 is closed by a sealing bolt 112, whereas only the open other end is selectively used as the supply port 110. Further, in the present embodiment, a case shall be described in which the supply port 110 and the first and second ports 22, 24 of the cylinder main body 12 are opened on the same one side surface, while the other side surface on which the third and fourth ports 26, 28 are disposed is sealed by means of the sealing bolt 112 (see FIG. 2).

Further, as shown in FIG. 2, in the interior of the end block 96, a piston chamber (chamber) 114 is formed so as to confront the first hole 104 of the spacer 94, and in the interior of the piston chamber 114, the sub-piston 98 is disposed for displacement along the axial direction (the direction of arrows A and B). Further, one end of the piston chamber 114 communicates with the supply port 110 through a communication passage 118*a*, whereas the other end of the piston chamber 114 communicates with the first hole 104.

The sub-piston 98 is formed in a cylindrical shape and is equipped on one end thereof with a conical portion (inclined portion) 120 that is reduced in diameter so as to taper gradually to a point. Additionally, the conical portion 120 of the sub-piston 98 is disposed so as to be capable of insertion into a piston hole 138 of the later-described lock plate 100, or into the first hole 104 of the spacer 94.

Further, in the interior of the end plate 96, an installation hole 122 is formed which faces toward the second through hole 36 in the cylinder main body 12. One end of the installation hole 122 communicates with the supply port 110 through a communication passage 118*b*. On the other hand, the other end of the installation hole 122 is formed so as to communicate with the second through hole 36 via the second hole 106 of the spacer 94. In addition, a portion of the coupling 102 is inserted in the installation hole 122.

The coupling 102 is equipped with a small diameter portion 124 that is inserted in the installation hole 122, and a large diameter portion 126, which is expanded in diameter with respect to the small diameter portion 124. The small diameter portion 124 is inserted in the installation hole 122 and a fitting hole 136 of the lock plate 100 as well as in the second hole 106 of the spacer 94, and the large diameter portion 126 is inserted into and seals the second through hole 36 of the cylinder main body 12. More specifically, the installation hole 122, the fitting hole 136, the second hole 106, and the second through hole 36 are formed on the same axis (i.e., co-axially).

Further, in the interior of the coupling 102, a communication hole 128 is formed so as to penetrate along the axial direction (the direction of arrows A and B) through the small diameter portion 124 and the large diameter portion 126. One end of the communication hole 128 communicates with the supply port 110 through the communication passage 118*b*, whereas the other end communicates with the second through hole 36 in the cylinder main body 12. Further, on the side of the small diameter portion 124 (in the direction of the arrow B) of the communication hole 128, an orifice (throttling means) 130 is provided, which is reduced in diameter in comparison with other regions of the communication hole 128. The flow amount of pressure fluid that flows through the communication hole 128 is throttled by the orifice 130, and then the pressure fluid is supplied into the second through hole 36.

More specifically, the pressure fluid supplied to the supply port 110 is supplied to the piston chamber 114 that constitutes the lock mechanism 20, and simultaneously is supplied through the communication hole 128 of the coupling 102 to the second through hole 36 of the cylinder main body 12.

Furthermore, in the coupling 102, a spring 132 made up from, for instance, a coil spring is disposed on the outer circumferential side of the small diameter portion 124, the spring 132 being interposed between the end block 96 and the lock plate 100.

Figure 6A:
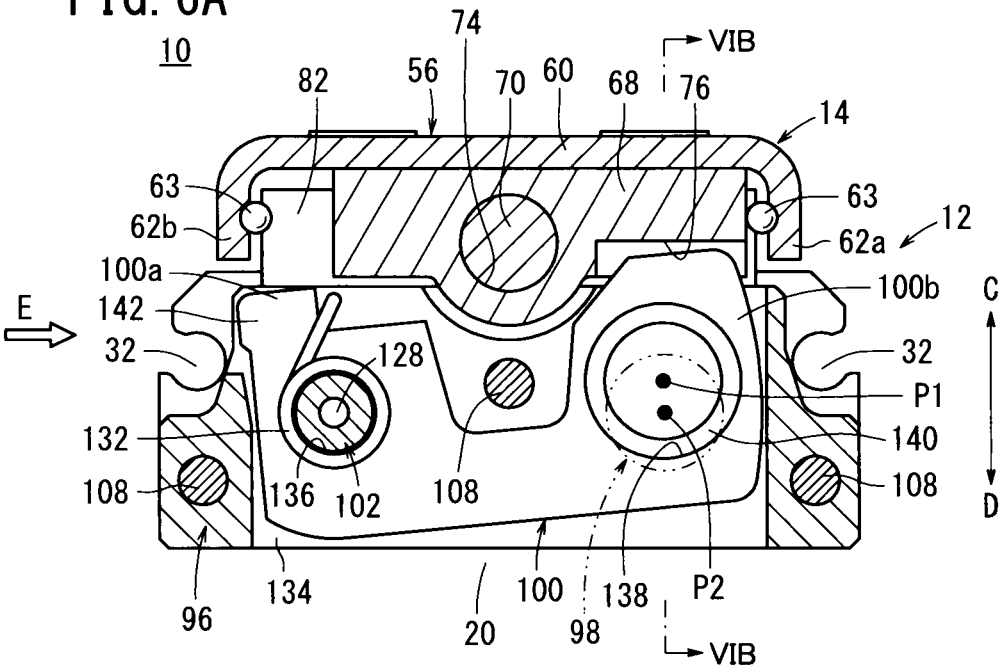
FIG. 6A is a cross sectional view showing a displacement restricted state in which displacement of a slide table is restricted by the lock mechanism.
Figure 7A:
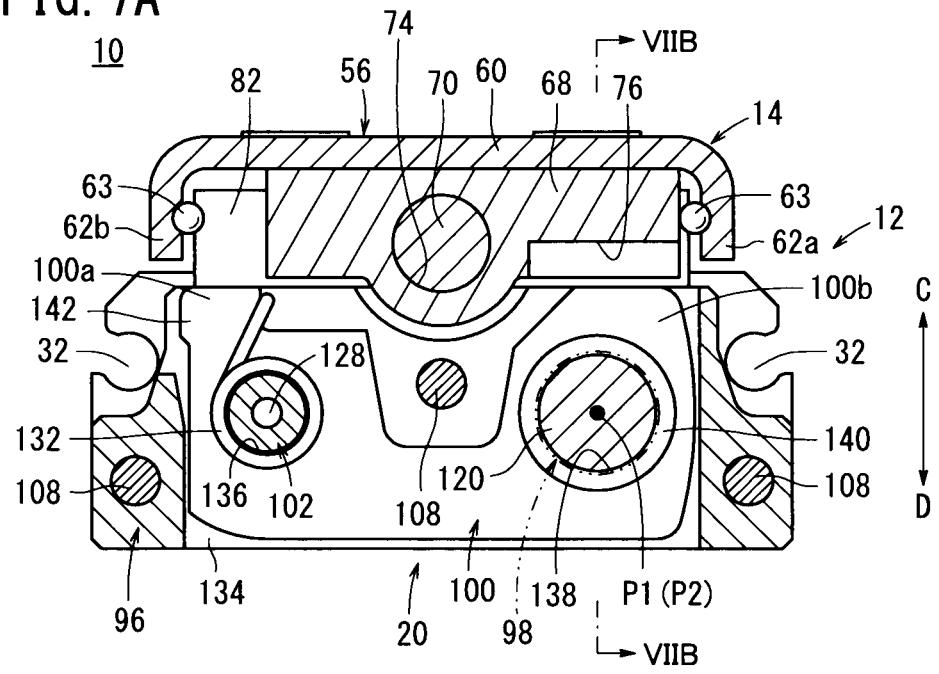
FIG. 7A is a cross sectional view showing a condition in which the displacement restricted state of the slide table by the lock mechanism is released.

As shown in FIGS. 6A and 7A, the lock plate 100 is made up from a plate-shaped body having a constant thickness and formed with a U-shape in cross section. The lock plate 100 is installed in a cavity 134, which is formed in an end surface on the side of the spacer 94 (in the direction of the arrow A) in the end block 96. The lock plate 100 is arranged in the cavity 134 substantially perpendicularly to the longitudinal direction (the direction of arrows A and B) of the cylinder main body 12. The fitting hole 136 through which the coupling 102 is inserted is formed in one end 100*a* of the lock plate 100, and the piston hole 138 into which a portion of the sub-piston 98 is inserted is formed in the other end 100*b* of the lock plate 100. In addition, the lock plate 100 is disposed in the cavity 134 interior, such that the other end 100*b* thereof having the piston hole 138 is rotatable through a predetermined angle about the fitting hole 136 through which the coupling 102 is inserted (i.e., with the fitting hole 136 acting as a center of rotation).

The small diameter portion 124 of the coupling 102 is inserted through the fitting hole 136, and the piston hole 138 includes a tapered surface 140, which is reduced in diameter gradually in a direction away from the sub-piston 98, or more specifically, toward the side of the spacer 94 (in the direction of the arrow A). The conical portion 120 of the sub-piston 98 abuts against the tapered surface 140 (see FIGS. 6B and 7B).

Figure 6B:
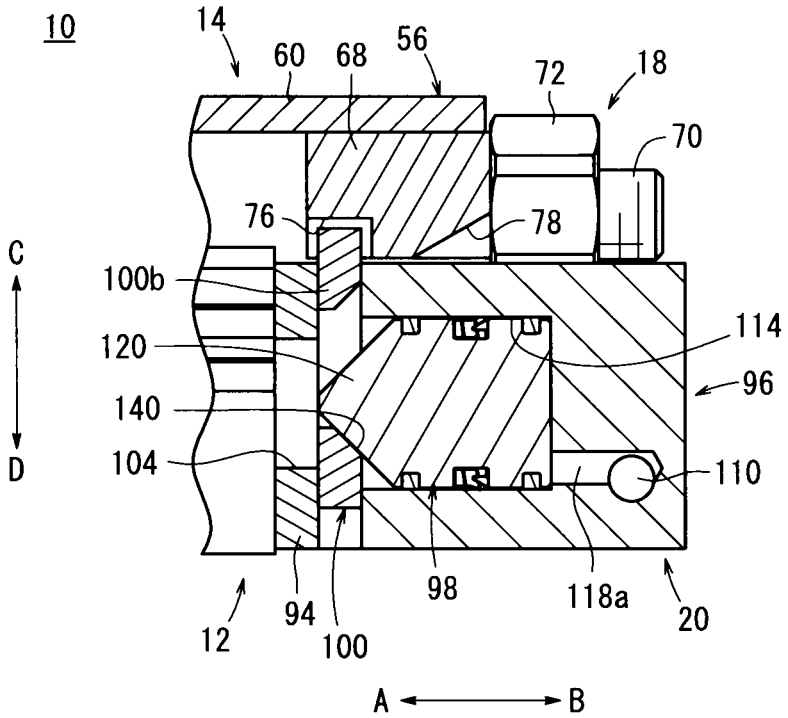
FIG. 6B is a cross sectional view taken along line VIB-VIB of FIG. 6A.

Further, an elastic force of the spring 132 is imposed on the lock plate 100, such that the other end 100*b* thereof is rotated upwardly (in the direction of the arrow C in FIG. 6A) by the elastic force, through a predetermined angle about the one end 100*a* that has the fitting hole 136 therein. In addition, as shown in FIGS. 6A and 6B, as a result of the other end 100*b* of the lock plate 100 projecting from the upper surface of the end block 96 and being inserted into the insertion groove 76 of the holder 68, which is fixed to the slide table 14, displacement of the slide table 14 along the axial direction (the direction of arrows A and B) is regulated. More specifically, a locked state can be established in which displacement of the slide table 14 is restricted.

At this time, as shown in FIG. 6A, the center P1 of the piston hole 138 in the lock plate 100 is in a state of being positioned upwardly (in the direction of the arrow C) with respect to the center P2 of the sub-piston 98, and the conical portion 120 of the sub-piston 98 is in a state of abutment only against the lower part of the piston hole 138. Stated otherwise, the center P1 of the piston hole 138 is located at a position that is offset upwardly by a predetermined distance with respect to the center P2 of the sub-piston 98.

Further, as shown in FIGS. 6A and 7A, a pressing portion 142 is disposed on the one end 100*a* of the lock plate 100 so as to be exposed through the cavity 134 on the side surface of the end block 96. The pressing portion 142 is disposed, for example, so as to be capable of being pressed by an operator from the exterior of the linear actuator 10, wherein by pressing the pressing portion 142 toward the inner side of the end block 96 (i.e., in the direction of the arrow E in FIG. 6A), the lock plate 100 can be rotated manually such that the other end 100*b* thereof descends. The pressing portion 142 is disposed on the one end 100*a* of the lock plate 100, and on a side surface thereof above the fitting hole 136 (i.e., in the direction of the arrow C).

The linear actuator 10 according to the embodiment of the present invention is constructed basically as described above. Next, operations and advantages of the linear actuator 10 shall be described. As shown in FIG. 1, a displacement restricted state (locked state) shall be described as an initial position, in which the end plate 58 constituting the slide table 14 abuts against one end surface of the cylinder main body 12, and as shown in FIGS. 6A and 6B, the lock plate 100 that makes up the lock mechanism 20 is inserted into the insertion groove 76 of the holder 68, whereby displacement of the slide table 14 is regulated.

First, after pipes, which are connected to a non-illustrated pressure fluid supply source, have been connected, for example, through a switching valve (not shown) to the supply port 110 and the second port 24, the pressure fluid from the pressure fluid supply source is introduced to the supply port 110. In this case, under operation of the switching valve, the second port 24 is placed in a condition of being opened to atmosphere, whereas the first port 22 is blocked by the blocking plug 30.

As shown in FIG. 2, the pressure fluid supplied to the supply port 110 is supplied to the piston chamber 114 through the communication passage 118*a*, and together therewith, after having flowed through the other communication passage 118*b* to the communication hole 128 of the coupling 102, is supplied to the second through hole 36 of the cylinder main body 12. At this time, because the orifice 130 is provided in the communication hole 128, the flow amount of pressure fluid supplied to the second through hole 36 is smaller than the flow amount of pressure fluid supplied to the piston chamber 114.

Figure 7B:
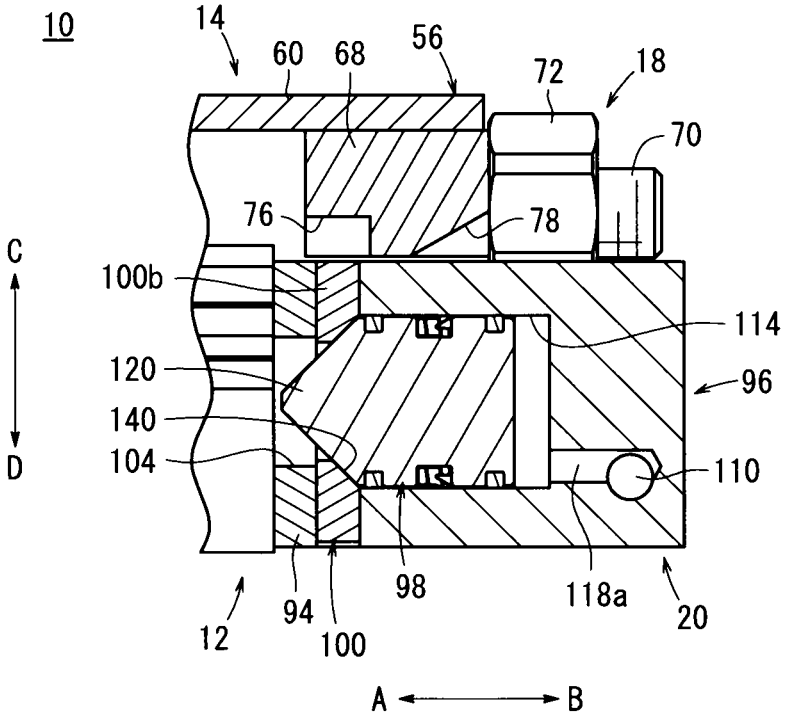
FIG. 7B is a cross sectional view taken along line VIIB-VIIB of FIG. 7A.

For this reason, at first, the sub-piston 98 is pressed toward the cylinder main body 12 (in the direction of the arrow A) by the pressure fluid that is supplied to the piston chamber 114, and the conical portion 120 thereof is moved while being in abutment with the piston hole 138 of the lock plate 100. Consequently, the tapered surface 140 of the piston hole 138 of the lock plate 100 is pressed downward (in the direction of the arrow D) by the conical portion 120 of the sub-piston 98 in opposition to the elastic force of the spring 132, and along therewith, as shown in FIGS. 7A and 7B, the other end 100*b* of the lock plate 100 separates away from the insertion groove 76 of the holder 68.

As a result, the displacement restricted state of the slide table 14 by the lock plate 100 is released, and the slide table is placed in a state enabling displacement thereof in the axial direction (the direction of the arrow A).

More specifically, the sub-piston 98 is displaced by supply of the pressure fluid, and the other end 100*b* of the lock plate 100 is rotated to separate away from the insertion groove 76, whereby the sub-piston 98 functions as a release mechanism, which is capable of releasing the displacement restricted state of the slide table 14 by the lock plate 100.

In the case that the displacement restricted state of the slide table 14 by the lock mechanism 20 is to be released, apart from the above-described method in which the lock plate 100 is rotated by displacement of the sub-piston 98 by means of a pressure fluid supplied to the supply port 110, an operator can also manually rotate the lock plate 100 by pressing the pressing portion 142 of the lock plate 100 from the exterior of the linear actuator 10, so that the other end 100*b* of the lock plate 100 separates away from the insertion groove 76 to thereby release the slide table 14.

In addition, after the displacement restricted state (locked state) of the slide table 14 by the lock mechanism 20 has been released, as a result of the pressure fluid supplied to the second through hole 36 reaching a supply amount capable of pressing the piston 40, together with the pressure fluid being supplied simultaneously to the first through hole 34 through the connection passage 54*b*, the pair of pistons 40 are pressed and displaced toward the side of the rod holders 50 (in the direction of the arrow A). Consequently, the slide table 14 is displaced, together with the end plate 58 and the piston rods 42 that are connected to the pistons 40, in a direction to separate away from the cylinder main body 12.

At this time, the balls 63 that make up the guide mechanism 16 roll along the ball circulation passages accompanying displacement of the slide table 14, whereby the slide table 14 is guided in the axial direction by the guide mechanism 16.

In addition, as a result of the end of the stopper bolt 70, which is disposed on the end of the slide table 14, coming into abutment against the end surface of the guide block 82 that makes up the guide mechanism 16, the displacement terminal end position of the slide table 14 is reached and further displacement of the slide table 14 is stopped. At this time, at the lock mechanism 20, because pressure fluid is supplied continuously to the piston chamber 114 through the supply port 110, the sub-piston 98 continues to be urged toward the side of the cylinder main body 12 (in the direction of the arrow A), and the state in which the other end 100*b* of the lock plate 100 is pressed downward (in the direction of the arrow D), i.e., the lock-released state, is maintained (see FIGS. 7A and 7B).

On the other hand, in the case that the slide table 14 is displaced in an opposite direction from the aforementioned displacement terminal end position (in the direction of the arrow B), under a switching action of the non-illustrated switching valve, pressure fluid is supplied to the second port 24, and simultaneously, the pressure fluid is supplied at a predetermined flow amount with respect to the supply port 110. Owing thereto, the pistons 40 are displaced in a direction away from the rod holders 50 (in the direction of the arrow B) by the pressure fluid, which is supplied from the second port 24 to the pair of first and second through holes 34, 36, and together with the pistons 40, the slide table 14 is displaced through the piston rods 42 and the end plate 58 in a direction to approach the cylinder main body 12.

In addition, the damper 80, which is disposed on the end plate 58 that makes up the slide table 14, abuts against the end surface of the cylinder main body 12, whereby the initial position is restored.

Further, during displacement of the slide table 14 toward the initial position, because the pressure fluid is supplied with respect to the supply port 110, under a displacement action of the sub-piston 98, the lock plate 100 is rotated and pressed downward, and the condition is maintained in which the displacement restricted state of the slide table 14 is released (see FIGS. 7A and 7B).

In addition, substantially simultaneously with arrival of the slide table 14 at the initial position, supply of pressure fluid with respect to the supply port 110 is halted by a non-illustrated switching means, the lock plate 100 is rotated by the elastic force of the spring 132, and the other end 110*b* thereof is inserted upwardly into the open insertion groove 76 of the holder 68 (see FIGS. 6A and 6B). Consequently, the displacement restricted state (locked state), in which displacement of the slide table 14 in the axial direction (the direction of the arrow A) is restricted, is established once again.

Further, for example, if the supply of pressure fluid with respect to the supply port 110 is stopped for any reason before the slide table 14 is restored to the initial position, even in the case that the other end 110*b* of the lock plate 100 is moved upwardly (in the direction of the arrow C) under the elasticity of the spring 132 and projects beyond the upper surface of the end block 96, the inclined surface 78, which is provided on the holder 68 of the slide table 14, comes into abutment against the other end 100*b*, and by further displacement of the slide table 14, the lock plate 100 is gradually depressed downward (in the direction of the arrow D) by the inclined surface 78 in opposition to the elastic force of the spring 132, so that ultimately, the other end 100*b* of the lock plate 100 becomes inserted again into the insertion groove 76. Owing thereto, before the slide table 14 is restored to the initial position, even in the event that the other end 100*b* of the lock plate 100 mistakenly projects upwardly (in the direction of the arrow C), restriction of displacement of the slide table 14 in front of the desired position can reliably be prevented as a result of the holder 68 coming into contact with the lock plate 100.

In the foregoing manner, according to the present embodiment, the lock mechanism 20 is provided on one end of the cylinder main body 12, which is capable of regulating displacement of the slide table 14 in the axial direction (the direction of arrows A and B), the lock mechanism 20 being constituted by the sub-piston 98 that is displaced by pressure fluid supplied to the supply port 110, and the lock plate 100, which is rotated upon displacement of the sub-piston 98 and is inserted into the insertion groove 76 of the holder 68 that is installed on the slide table 14.

In the lock mechanism 20, because the lock plate 100 is formed in a plate-like shape and is disposed for rotation in a direction substantially perpendicular to the axial direction (the direction of arrows A and B) of the linear actuator 10, the linear actuator 10 is not increased in scale in the axial direction, and in addition, because the sub-piston 98 is constituted so as to be displaceable in the longitudinal direction (the direction of arrows A and B) of the cylinder main body 12, the linear actuator 10 is not increased in scale in the height direction. As a result, enlargement in scale of the linear actuator 10 in both the longitudinal direction (the direction of arrows A and B) and the height direction (the direction of arrows C and D) is suppressed, while displacement of the slide table 14 in the axial direction can reliably be regulated or restricted by the lock mechanism 20.

Further, because the lock mechanism 20 is arranged in a space that is formed underneath the slide table 14, such a space, which would otherwise be dead space, can be utilized effectively, and an increase in the height dimension can be avoided.

Furthermore, because the sub-piston 98 of the lock mechanism 20 is driven using a portion of the pressure fluid that is supplied for displacement of the pistons 40 of the cylinder mechanism 44, compared to a case of separately supplying pressure fluid for the purpose of driving the sub-piston 98, the piping layout can suitably be simplified.

Still further, because the orifice 130 is provided in the communication hole 128 of the coupling 102, the supplied amount of pressure fluid, which is supplied from the supply port 110 to the second through hole 36 of the cylinder main body 12, is smaller than the supplied amount of pressure fluid that is supplied to the piston chamber 114 of the lock mechanism 20. Owing thereto, preceded by a predetermined flow amount being supplied to the piston chamber 114, it is possible for the sub-piston 98 to be displaced and the displacement restricted state of the slide table 14 by the lock plate 100 to be released, and thereafter, the pistons 40 of the cylinder mechanism 44 are pressed and the slide table 14 can be displaced.

Stated otherwise, by providing the orifice 130, a difference is established between the supplied amount of pressure fluid that is supplied to the piston chamber 114 and the supplied amount of pressure fluid that is supplied to the second through hole 36, and thus a time difference occurs in the times at which the sub-piston 98 and the pistons 40 start to move. Consequently, the slide table 14 can reliably be displaced after the locked state of the slide table 14 by the lock mechanism 20 has been released.

The linear actuator according to the present invention is not limited to the above-described embodiment, and it is a matter of course that various modified or additional structures may be adopted therein without deviating from the essence and gist of the present invention.

What is claimed is:

1. A linear actuator for reciprocally displacing a slide table along an axial direction of a cylinder main body by introducing a pressure fluid from fluid inlet/outlet ports, comprising:

the cylinder main body, which communicates with the fluid inlet/outlet ports and having a cylinder chamber into which the pressure fluid is introduced;

the slide table, which is reciprocally displaced along the axial direction of the cylinder main body;

a cylinder mechanism having a piston slidably disposed for displacement along the cylinder chamber, and which reciprocally displaces the slide table by displacement of the piston; and a lock mechanism having a locking member that is rotatably displaceable perpendicular to a displacement direction of the slide table and comes into engagement with the slide table, and a biasing means that causes displacement of the locking member, wherein the lock mechanism is disposed at one end of the cylinder main body and restricts reciprocal displacement of the slide table.

2. The linear actuator according to claim 1 further comprises a release mechanism for releasing the restricted state of reciprocal displacement of the slide table by the locking member.

3. The linear actuator according to claim 2, wherein the release mechanism comprises an inclined surface that faces toward the lock mechanism, and which rotates the locking member in opposition to an urging force of the biasing means for releasing the restricted state of reciprocal displacement by the locking member.

4. The linear actuator according to claim 3, wherein the inclined surface changes gradually in the depth along the direction of displacement of the slide table.

5. The linear actuator according to claim 1, wherein the biasing means comprises a spring that exhibits an elastic force.

6. The linear actuator according to claim 1, wherein the locking member is rotated under an urging action by the biasing means so as to be inserted into and come into engagement with a cooperating element of the slide table.

7. The linear actuator according to claim 6, wherein the locking member is rotatably displaceable about an axis extending parallel to the axial direction of the cylinder main body.

8. The linear actuator according to claim 1, wherein the locking member is rotatably displaceable about an axis extending parallel to the axial direction of the cylinder main body.

9. The linear actuator according to claim 8, wherein the locking member is plate shaped.

10. The linear actuator according to claim 1, wherein the locking member is plate shaped.

11. A linear actuator for reciprocally displacing a slide table along an axial direction of a cylinder main body by introducing a pressure fluid from fluid inlet/outlet ports, comprising:

the cylinder main body, which communicates with the fluid inlet/outlet ports and having a cylinder chamber into which the pressure fluid is introduced;

the slide table, which is reciprocally displaced along the axial direction of the cylinder main body;

a cylinder mechanism having a piston slidably disposed for displacement along the cylinder chamber, and which reciprocally displaces the slide table by displacement of the piston; a lock mechanism having a locking member that is displaceable perpendicular to a displacement direction of the slide table and comes into engagement with the slide table, and a biasing means that causes displacement of the locking member, wherein the lock mechanism is disposed at one end of the cylinder main body and restricts reciprocal displacement of the slide table; and a release mechanism for releasing the restricted state of reciprocal displacement of the slide table by the locking member, wherein the locking member is rotated under an urging action by the biasing means so as to be inserted into and come into engagement with a groove of the slide table.

12. The linear actuator according to claim 11, wherein the release mechanism comprises a displaceable body which is displaced axially by supply of the pressure fluid to thereby cause the locking member to be rotated in a direction away from the slide table.

13. The linear actuator according to claim 12, wherein one of the fluid inlet/outlet ports communicates respectively with a chamber in which the displaceable body is disposed and the cylinder chamber, and wherein a throttling means for throttling a flow amount of the pressure fluid into the cylinder chamber is disposed between the one fluid inlet/outlet port and the cylinder chamber.

14. The linear actuator according to claim 13, wherein the throttling means comprises an orifice.

15. The linear actuator according to claim 12, wherein an inclined portion, which is inclined with respect to the axial direction, is provided on the displaceable body, the inclined portion abutting against the locking member.

16. The linear actuator according to claim 12, wherein a center of the piston and a center of the displaceable body are disposed in an offset manner from one another.

17. The linear actuator according to claim 11, wherein the release mechanism causes the restricted state of reciprocal displacement by the locking member to be restored, when the groove arrives at a position confronting the locking member under a displacement action of the slide table.

18. The linear actuator according to claim 11, wherein the locking member is disposed such that one end thereof, which acts as a center of rotation, is exposed to the exterior.

19. A linear actuator for reciprocally displacing a slide table along an axial direction of a cylinder main body by introducing a pressure fluid from fluid inlet/outlet ports, comprising:

the cylinder main body, which communicates with the fluid inlet/outlet ports and having a cylinder chamber into which the pressure fluid is introduced;

the slide table, which is reciprocally displaced along the axial direction of the cylinder main body;

a cylinder mechanism having a piston slidably disposed for displacement along the cylinder chamber, and which reciprocally displaces the slide table by displacement of the piston; and a lock mechanism having a locking member that is rotatably displaceable perpendicular to a displacement direction of the slide table and comes into engagement with the slide table, and a biasing means that causes displacement of the locking member, wherein the lock mechanism is disposed at one end of the cylinder main body and restricts reciprocal displacement of the slide table, wherein the locking member is formed in a plate-like shape, one end thereof acting as a fulcrum about which another end of the locking member rotates.

* * * * *